US006878020B1

(12) United States Patent
Adomeit

(10) Patent No.: US 6,878,020 B1
(45) **Date of Patent: *Apr. 12, 2005**

(54) JET BOAT EMERGENCY BRAKING SYSTEM

(76) Inventor: Mark E. Adomeit, 779 Phoenix Rd., South Haven, MI (US) 49090

( * ) Notice: Subject to any disclaimer, the term of this patent is extended or adjusted under 35 U.S.C. 154(b) by 0 days.

This patent is subject to a terminal disclaimer.

(21) Appl. No.: 10/627,482

(22) Filed: Jul. 24, 2003

Related U.S. Application Data

(62) Division of application No. 09/793,875, filed on Feb. 28, 2001, now Pat. No. 6,652,333.

(51) Int. Cl.[7] ..... B63H 11/117
(52) U.S. Cl. ..... 440/43
(58) Field of Search ..... 440/40–43, 38; 114/144 R

(56) References Cited

U.S. PATENT DOCUMENTS 5,988,091 A * 11/1999 Willis ..... 114/145 R
6,443,785 B1 * 9/2002 Swartz et al. ..... 440/40
6,652,333 B1 * 11/2003 Adomeit ..... 440/43

* cited by examiner

*Primary Examiner*—Ed Swinehart
(74) *Attorney, Agent, or Firm*—Alex Rhodes

(57) ABSTRACT

A braking system for a personal water craft which is activated when a high velocity water jet is cut off. The braking system is comprised of a planar member attached to a rear portion of the water craft. The braking member is movable to an elevated non-operative position during a discharge of the high velocity water jet and to a lowered operative position during a cut off of the water jet. In a first embodiment of the invention, the planar braking member is automatically movable to the operative position and to the non-operative position. In a second embodiment, the planar braking member is manually elevated to the non-operative position and manually lowered to the operative position by a link or a cable.

11 Claims, 5 Drawing Sheets

JET BOAT EMERGENCY BRAKING SYSTEM

This is a divisional application of U.S. application Ser. No. 09/793,875 filed on Feb. 28, 2001 now U.S. Pat. No. 6,652,333.

FIELD OF THE INVENTION

This invention relates to water craft and more particularly to an emergency braking system for a jet propelled water craft.

BACKGROUND OF THE INVENTION

Jet propelled personal water craft (PWC) have become increasingly popular during recent years. They are shallow draft boats and jet skis which are propelled by impulses of high velocity water jets. The water jets are discharged through nozzles, mounted at the rear of boats. They are steered by rotating the nozzles about vertical axes with linkages or cables. The rotations of the nozzles change the directions of the water jets causing the boats to change their courses. They are generally operated within the confines of small inland lakes.

The high speeds and maneuverability of PWC are the reasons for their popularity with water sportsmen. During 1997, approximately 200,000 PWC were sold in the U.S.A. The sales constituted more than one-third of new recreational boat sales. About 1 million are in current use and their numbers are growing.

Injuries and casualties are major problems with PWC. The National Transportation Safety Board is concerned about the safety of PWC and is searching for solutions. A major cause of the safety problems is that steering is lost when an engine fails. The loss of steering plus a lack of braking is particularly serious because of the high speeds and the manner in which PWC are operated within the confines of the small lakes. The loss of steering and lack of braking can result in a grounding of a PWC or a collision with a swimmer or other water craft.

SUMMARY OF THE INVENTION

The present invention is a solution to the problem of the lack of braking when an engine fails. The solution resides in novel features which individually and collectively contribute to the ability of the invention to slow a PWC when an engine fails. An important benefit of the invention is that an existing PWC can be easily and economically retrofitted with the invention. An important feature of the invention is that an emergency braking system is activated when an engine fails. Another benefit is that the emergency braking system may be immediately activated when an engine fails.

In a first embodiment of the invention, a rudder is pivotally mounted on a nozzle of a PWC for rotation about a horizontal axis. When the PWC's engine is started, the rudder is elevated to a non-operative position by an impingement of a water jet on a baffle which is in covering relationship with an outlet of the nozzle. If the engine fails, the rudder is automatically lowered to a submerged operative position by gravitational and hydrodynamic forces. At the submerged operative position, braking forces are generated by a planar braking fin on the rudder. When the engine is re-started, the rudder and braking fin are automatically raised by the water jet to the elevated non-operative position.

In a second embodiment of the invention, one end of a cable or link is attached to a rudder with a braking fin and an opposite end of the cable or link is attached to a usual type of manual control. If the water jet is cut-off because of an engine failure, the rudder and braking fin are manually lowered by a PWC operator to operative positions.

In employing the teachings of the present invention, a plurality of alternate constructions can be adopted to achieve the desired results and capabilities. In this disclosure, only several aspects of the invention are discussed. However, these aspects are intended as examples and should not be considered as limiting the scope of the invention.

Further objects, benefits and features of the invention will become apparent from the ensuing detailed description and drawings which illustrate and describe the invention. The best mode which is contemplated in practicing the invention together with a preferred manner of using the invention are disclosed and the property in which exclusive rights are claimed is set forth in each of a series of numbered claims at the conclusion of the detailed description.

BRIEF DESCRIPTION OF THE DRAWINGS

The invention will be better understood and further objects, characterizing features, details and advantages thereof will appear more clearly with reference to the diagrammatic drawing illustrating a presently preferred specific embodiment of the invention by way of non-limiting example only.

DETAILED DESCRIPTION OF A PREFERRED EMBODIMENT

Figure 1:
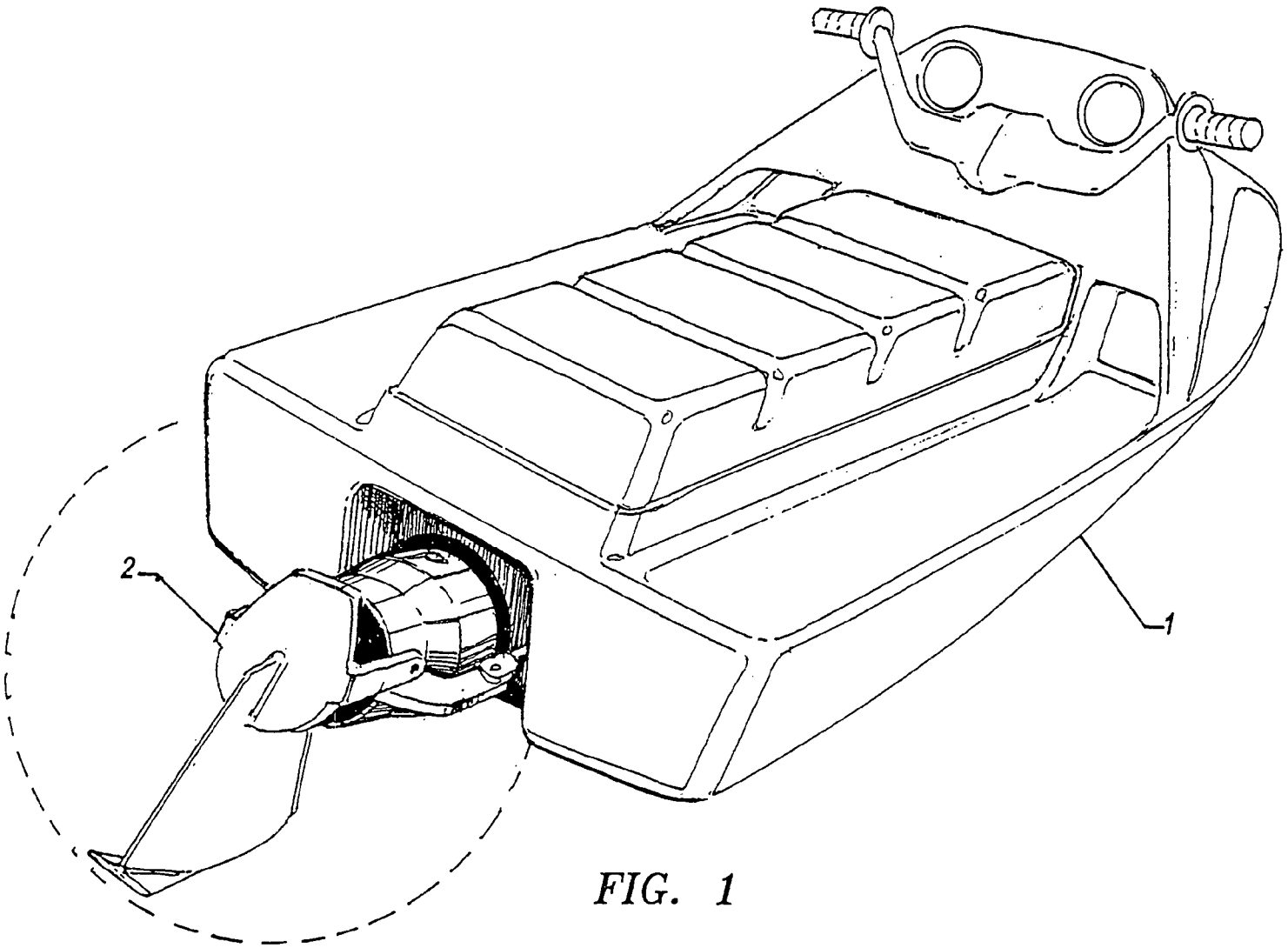
FIG. 1 is a perspective view of a jet boat with an auxiliary steering system according to the present invention.

Referring now to the drawings wherein like numerals designate like and corresponding parts throughout the several views, a PWC 1 is shown in FIGS. 1 through 5, inclusive, with a steering system according to the present invention 2. The style of the PWC 1 is arbitrary and is not intended to limit the scope of the invention, since PWC's are available in a variety of shapes.

Figure 3:
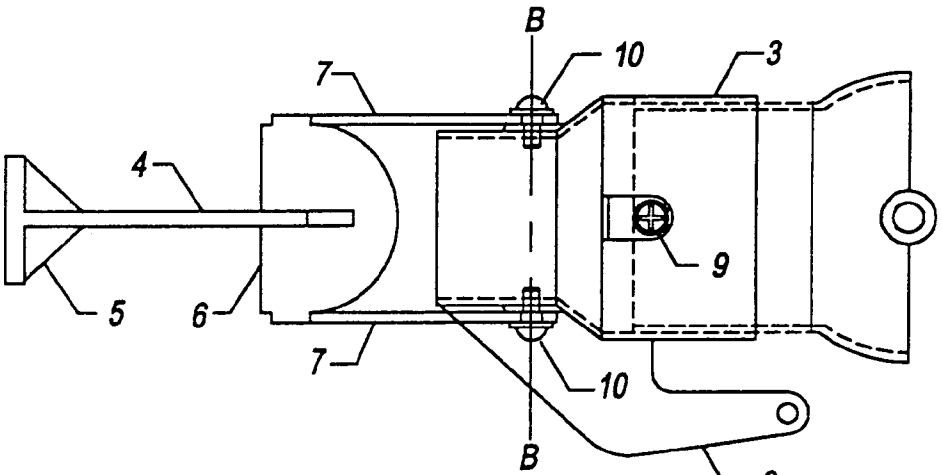
FIG. 3 is a plan view of the auxiliary steering system in an operative position.
Figure 4:
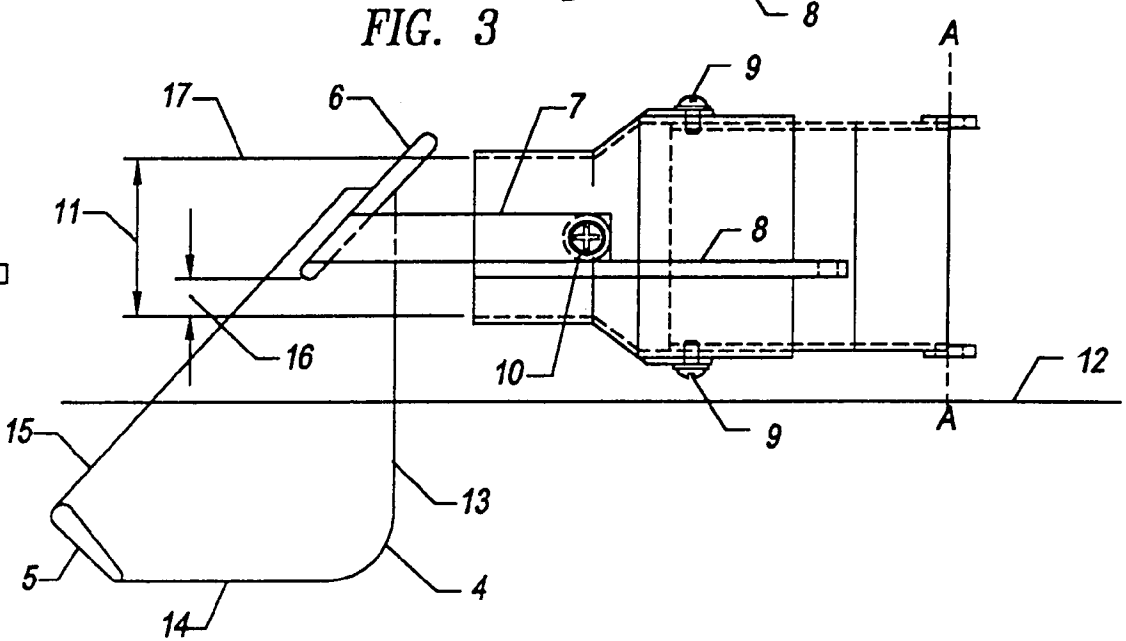
FIG. 4 is a right side view of the auxiliary steering system in the operative position.
Figure 5:
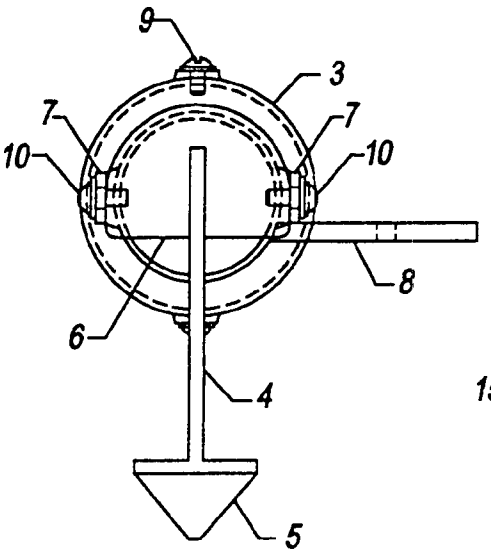
FIG. 5 is a rear view of the auxiliary steering system in the operative position.

The invention is best understood by reference to FIGS. 3 and 4. A nozzle 3 is mounted at the center and rear of the PWC is with a pair of threaded fasteners 9. The nozzle 3 is rotatable about a vertical axis A—A. The PWC 1 is propelled through the water by the impulse of a high velocity water jet 11 which is discharged from the nozzle 3, a small distance above the a body of water 12. During the normal operation of the PWC 1, the PWC 1 is steered by rotating the nozzle 3 with a linkage or cable about the vertical axis A—A. The linkage or cable is connected to a steering arm 8 at the side of the nozzle 3. The linkage or cable, rotates the nozzle 3 clockwise or counterclockwise about the vertical axis A—A.

One feature of the invention is a triangular shaped rudder 4 which is pivotally attached to the nozzle 3 with shoulder bolts 10 and a yoke shaped arrangement of a pair of forwardly extending arms 7. The rudder 4 is rotatable about a horizontal axis B—B, from the lower operative position, shown in FIGS. 1 through 5 to the upper non-operative position, shown in FIG. 6. In order to minimize the influence of the rudder 4 on the performance of PWC 1 it is desirable that the rudder 4 is as small as possible.

To meeting this end, a triangular shaped rudder 4 is provided which resembles a 45 degree right triangle. The rudder has a vertical front edge 13, a horizontal lower edge 14 and an inclined rear edge 15. Although other shapes can be used, the triangular shape provides two benefits. One benefit is that the centroid of the rudder's area lies substantially rearward of the nozzle's vertical pivot axis A—A. The rearward positioning of the centroid increases the steering effectiveness of the rudder 4 over other shapes. The other benefit is that the center of gravity of the rudder 4 lies substantially rearward of the rudder's horizontal pivot axis B—B. The rearward positioning of the center of gravity, reduces the need for a ballast weight at the end of the rudder for lowering the rudder 4 if an engine fails. However, it should be appreciated than ballast weights may be used for lowering the rudder.

At the upper end portion of the rudder there is a baffle 6 for elevating the rudder 4 to the non-operative position. Referring to FIG. 4, when the rudder 4 is at the operative position, the baffle 6 is inclined at about a 45 degree angle and is in substantial covering relationship with an outlet of the nozzle 4 and the arms 7 rest on the steering arm 8 of the nozzle 3. The rudder 4 is positioned such that in the operative position of the rudder 4 the distance 16 between the lowermost edge of the baffle 4 to the lower edge of the water jet 11 is about one quarter of the diameter of the water jet 11. This spacing is to prevent the stalling of an engine during start-up when the engine rpm and power are low.

Figure 6:
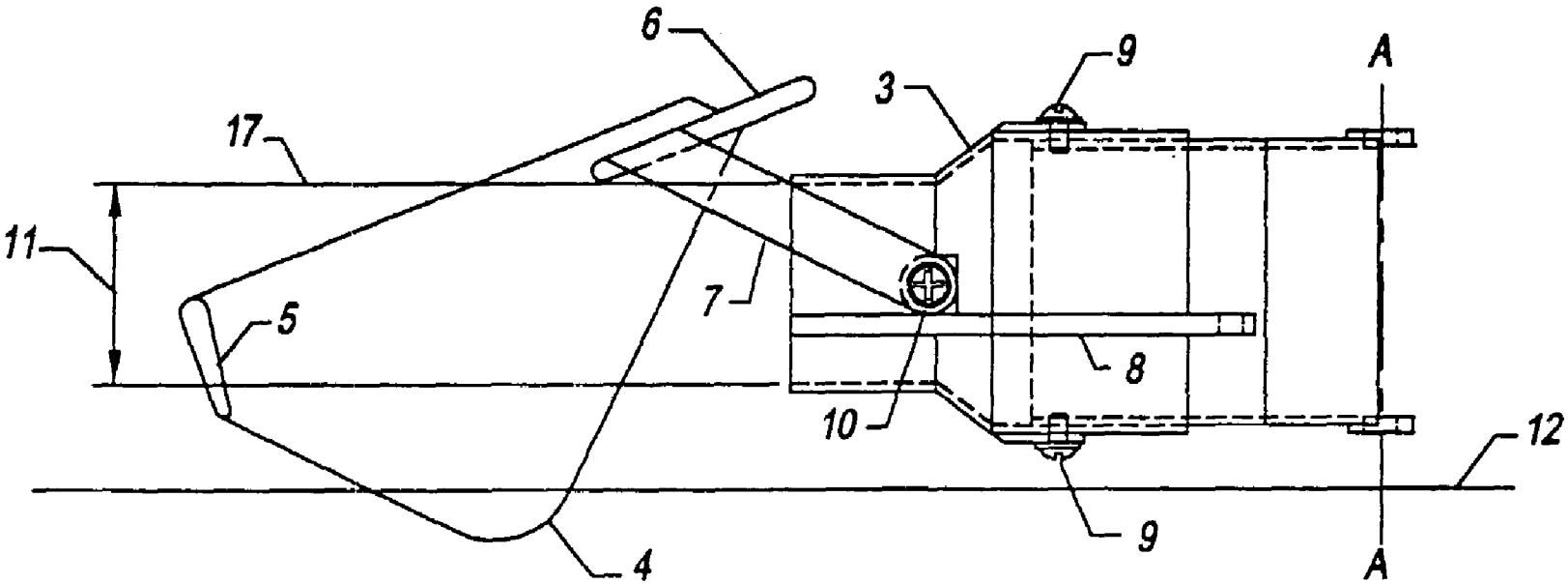
FIG. 6 is a right side view of the auxiliary steering system in a non-operative position.

When the engine is started, the water jet 11 impinges on the baffle 6, elevating the rudder 4 to the non-operative position shown in FIG. 6. At this position, the lower edge of the baffle 6 is aligned with the upper edge 17 of the water jet 11. So long as the engine continues to operate, the baffle 6 will maintain the rudder 4 in the non-operative position. If the engine fails, the water jet will stop and the rudder 4 will rotate downwardly by hydrodynamic and gravitational forces to the operative position shown in FIGS. 1 through 5.

Figure 2:
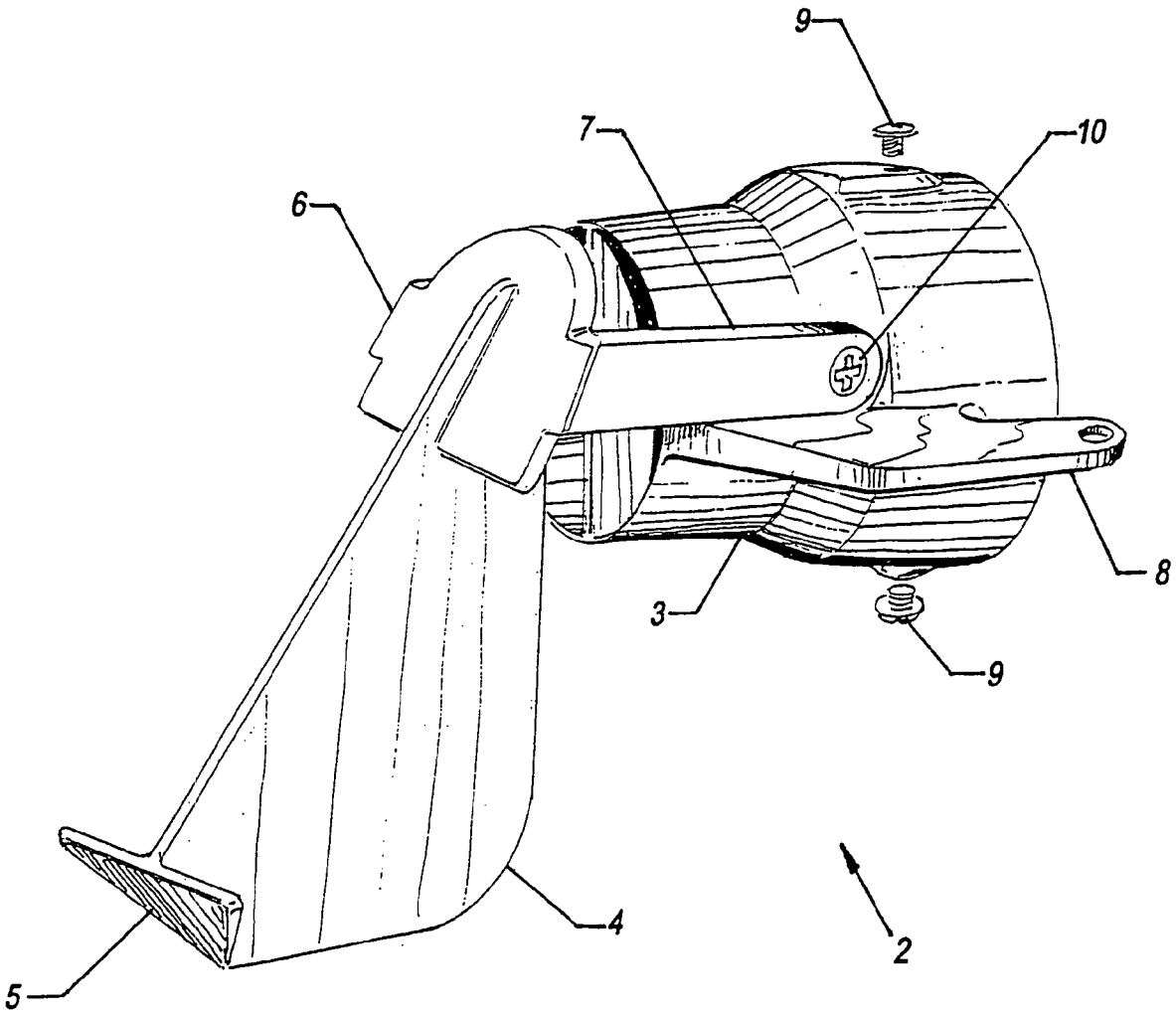
FIG. 2 is an enlarged perspective view of the auxiliary steering system.

Referring now to FIG. 2, another important feature of the invention is a triangular fin 5, at the truncated corner of the rudder 4 where the inclined edge 15 approaches the horizontal edge 14. When the rudder 4 is at its operative position, braking forces are generated by the triangular fin 5 which assist an operator in controlling the PWC.

In summary, the invention is used in the following manner. When the PWC 1 is idle, the baffle 6 is in substantial covering relationship with the outlet of the nozzle 3. When the engine of the PWC 1 is started, a high velocity water jet 11 impinges on the baffle 6, raising the rudder 4 to the non-operative position shown in FIG. 6. The rudder 4 remains at the elevated non-operative position during normal conditions by the water jet 11. If the water jet 11 is cut off by an engine failure, gravitational and hydrodynamic forces acting on the rudder, cause the rudder 4 to rotate about the horizontal axis B—B to the operative position, allowing a boat operator to steer his PWC by rotating the rudder 4 which is attached to the rudder 4 about the axis A—A.

It will be appreciated that the automatic lowering of the rudder 4 forestall mishaps due to the panic of some boat operators. It will also be appreciated that the automatic lowering of the rudder 4 immediately brings into play the braking forces of the triangular fin 7.

Figure 7:
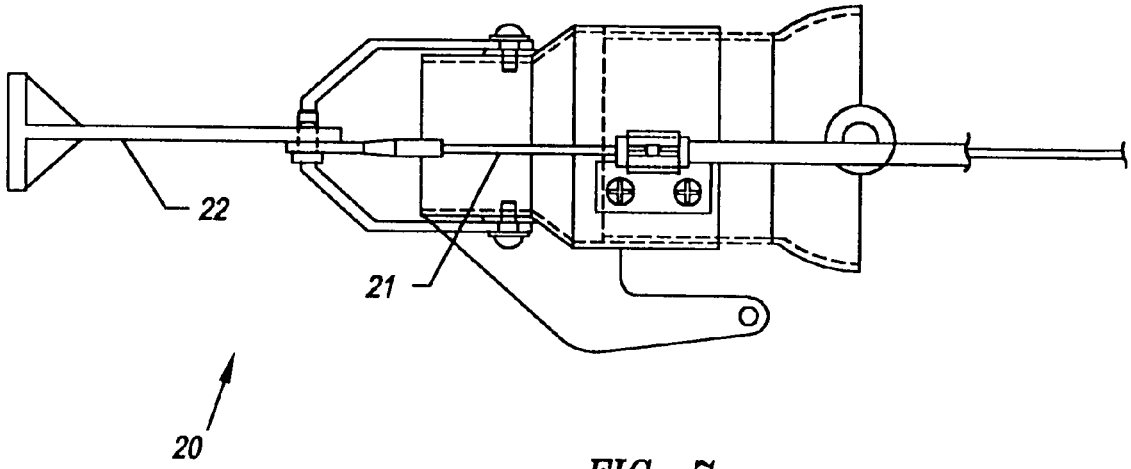
FIG. 7 is a plan view of an alternate embodiment of the invention.
Figure 8:
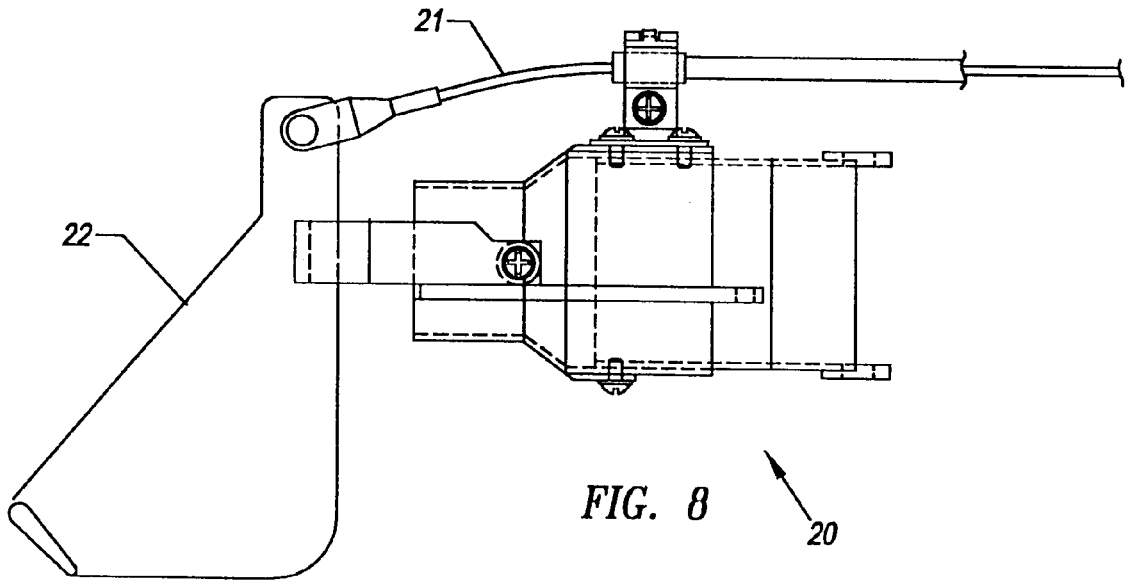
FIG. 8 is a right side view of the alternate embodiment in an operative position.

In the alternate embodiment 20 of FIGS. 7 and 8, a less effective means is used for raising and lowering a rudder 22. The rudder 22 is raised and lowered with a push-pull cable 21 having one end portion attached to an upper portion of the pivotally mounted rudder 22 and at an opposite end portion to a usual manual control (not shown). Since an action of a boat operator is required to raise and lower the rudder 22, it will be understood that this embodiment has an obvious disadvantage over the first embodiment.

From the above, it is apparent that my invention is a total solution to the problem of lost steering in a PWC because of an engine failure. Moreover, my invention provides the important advantages of simplicity, moderate cost, automatic operation, emergency braking, and adaptability to current PWC. Most importantly, it will reduce injuries and fatalities relating to PWC.

Although only two embodiments of my invention have been illustrated and described, it is obvious that other embodiments can be developed by obvious changes in shape, number of parts, inversions of parts, substitutions of materials, and substitutions of parts without departing from the spirit thereof.

What I claim is new is:

1. An emergency braking system which is activated when a high velocity water jet of a PWC is cut-off, said braking system comprising: a rearward extending upwardly inclined planar braking member mounted on a rudder at a rear portion of said water craft, said braking member being movable with said rudder from an elevated non-operative position to a lowered submerged operative position for generating braking forces when said water jet is cut off; a means for elevating said rudder and braking member to said elevated non-operative position during a normal operation of said water craft and a means for lowering said rudder and braking member to said lowered operative position.

2. The emergency braking system recited in claim 1 wherein said means for elevating said rudder and braking member to said elevated non-operative position during said normal operation of said water craft is an automatic means.

3. The braking system recited in claim 1 wherein said means for lowering said rudder and braking member to said lowered operative position after said cut-off of said high velocity water jet is an automatic means.

4. The braking system recited in claim 3 wherein said automatic means for elevating said rudder and braking member to said non-operative position is a baffle in covering relationship with an outlet of said nozzle at said lowered operative position, said baffle intercepting said water jet.

5. The braking system recited in claim 4 wherein said automatic means for lowering said rudder and braking member to said lowered submerged operative position when said water jet is cut off is gravity.

6. The braking system recited in claim 1 wherein said means for elevating said rudder and planar braking member is a manually operated push-pull cable.

7. In a PWC which is propelled and steered by an impulse of a high velocity water jet discharged through a nozzle at the rear of the water craft, the improvement comprising: a rudder for steering said PWC, said rudder mounted for rotation about a horizontal axis on a rear portion of said water craft from an elevated non-operative position to a lowered submerged operative position when said high velocity water jet of said water craft is cut off; a means for said mounting of said rudder; a rearward extending upwardly inclined planar braking member mounted on said rudder for generating braking forces at said rudder's lowered operative position when said water jet is cut off; a means for raising said rudder to said elevated non-operative position; and a means for lowering said rudder to said lowered submerged operative position.

8. The improvement recited in claim 7 wherein said means for mounting said rudder is a yoke shaped arrangement of a pair of forward extending arms and a pair of shoulder bolts for attaching said arms to opposite side portions of said nozzle.

9. The improvement recited in claim 7 wherein said braking member comprises a rearward extending upwardly inclined transverse triangular fin on a lower rear corner of said rudder for providing said braking forces when said rudder is in said lowered operative position.

10. In combination with a rudder of a PWC which is operative during a discharge of a high velocity water jet at a rear of said PWC, said rudder being movable between two positions, an elevated non-operative position during said discharge of said water jet and a lowered submerged operative position when said water jet is cut off; a rearward upwardly extending planar braking member extending laterally outward from opposite sides of a lower portion of said rudder for generating braking forces when said water jet is cut off, said planar braking member being operative when said rudder is operative and being non-operative when said rudder is non-operative.

11. The combination recited in claim 10 wherein said planar braking member is a triangular shaped member.

* * * * *